US005133788A

United States Patent [19]

Backus

[11] Patent Number: 5,133,788

[45] Date of Patent: Jul. 28, 1992

[54] AIR FILTERING DEVICE

[76] Inventor: Alan L. Backus, #210 1550 Centinela Ave., Los Angeles, Calif. 90025

[21] Appl. No.: 506,603

[22] Filed: Apr. 10, 1990

[51] Int. Cl.[5] ..... B01D 46/00

[52] U.S. Cl. ..... 55/467; 55/486; 55/316; 55/131; 55/387; 454/188

[58] Field of Search ..... 55/124, 131, 126, 139, 55/486, 467, 473, 316, 413, 414, 387; 98/36, 39.1, 40.15, 31.5; 415/182.1, 203, 206, 211.2; 454/188

[56] References Cited

U.S. PATENT DOCUMENTS 1,372,251 3/1941 Schnee ..... 415/211.2
2,044,832 6/1936 Child ..... 55/473
2,065,970 12/1936 Hartzell ..... 55/473
4,173,995 11/1979 Beck ..... 415/211.2

*Primary Examiner*—Bernard Nozick
*Attorney, Agent, or Firm*—Fleit, Jacobson, Cohn, Price, Holman & Stern

[57] ABSTRACT

An air cleaning device produces a vertical plane of moving air to block migration of airborne impurities from one area to another, and to create a low pressure area which remotely attracts impure ambient air to it. The device may have one or more restricted air inlets orthogonal to the vertical plane of moving air, with restrictions creating increased air velocity at the inlets resulting in a low pressure zone which attracts impure ambient air to the inlets. A single stage activated charcoal filter which removes chemicals and odors may be provided within the device, as well as an ionizer which electrostatically removes particulates.

3 Claims, 3 Drawing Sheets

AIR FILTERING DEVICE

BACKGROUND OF THE INVENTION

1. Field of Invention

The present invention relates to air cleaning devices, particularly air filtering devices. More especially, the present invention relates to room air filtering devices having the ability to attract polluted air into their inlets. Still more particularly, the present invention relates to room air filtering devices able to block air movement from one area to another. The invention also relates to a method of cleaning room air.

2. Description of Prior Act

Room air filtering devices have been known for many years. The most common of these devices use centrifugal, axial or other types of fans to draw or force air through filters which remove gaseous and-or particulate pollutants. Such devices range in size from a few inches on a side to console sized units over thirty inches in height. Typically such devices are placed in a room where they rely on ambient air movement to bring polluted air to their inlets.

More recently electronic ionizer air cleaner units have been introduced which eliminate particulate pollutants from the air by imparting them with a static charge which attracts them to electrically grounded objects such as furniture, carpets, and walls. Such ionizer units are typically small, averaging only a few inches on each side. Again, ionizer air cleaners rely on ambient air movement to bring room air to their ionizer elements. One of the primary complaints about ionizers is that they make furniture, carpets and walls dirty. To prevent this, some ionizers supply grounding elements which attract the statically charged pollutants and help keep them from depositing on furniture, walls and other room objects.

Some fan-filter air cleaning devices have built-in ionizers. Such arrangements generally have both the advantages and disadvantages listed above including relying on ambient air movement to attract polluted air, and soiling of furniture and walls.

Because ionizers and fan-filter air cleaners can not effectively draw polluted air to them, some use scenting pellets or liquids to mask odors. This makes pollutants such as cigarette smoke and cooking odors less noticeable, but does so at the cost of adding more impurities to the air.

None of the above air cleaners blocks the migration of impure air from one area to another. Such a feature would be useful for example, in preventing pollen from entering a room, stopping odors from leaving a bathroom, containing cooking odors within a kitchen, localizing odors from a kitty litter box, or stopping cigarette smoke drifting across an office or a restaurant.

Also, none of the above types of air cleaners have the ability to draw airborne impurities to their inlets. Such a feature would be useful in pulling cigarette smoke directly from an ashtray or a lit cigarette into a filter, eliminating tearing a lit cigarette into a filter, eliminating tearing caused by cutting an onion by filtering it at its source, or in immediately filtering kitty litter, pet, cooking or other odors at their source.

OBJECTS OF THE INVENTION

In view of the foregoing drawbacks and deficiencies of the prior art, it is an object of the present invention to provide means for blocking the migration of impure air from one area to another.

It is another object of the present invention to provide filtering means which can remotely draw air toward and into its inlet.

It is yet another object of the present invention to provide means for filtering impure air.

Readers will find further objects and advantages of the present invention from a consideration of the ensuing description and the accompanying drawings.

SUMMARY OF THE INVENTION

The present invention provides means to help block migration of impure air, for example, air containing: cigarette smoke; pollen; formaldehyde and other unhealthy chemicals; as well as cooking, pet, bathroom and other odors.

The present invention also provides means to positively draw impure air to its inlet rather than merely relying on random, ambient air movement.

To accomplish this, an embodiment of the present invention uses apparatus including one or more fans or other air movement devices, in some cases in combination with air deflection means, to radiate a vertical plane of moving air with the apparatus at its center. The plane of moving air creates an invisible shield of moving air which deflects ambient air and impurities which it contains from moving from one side of the shield to the other. Depending on how the apparatus is placed, this deflection plane of moving air may block room entrances, and-or subdivide room or other air spaces.

The plane of moving air also constitutes a plane of low pressure which attracts air on both sides of the plane towards the plane. This is because, as postulated by Jacques Bernoulli, moving air creates low pressure, with such low pressure being directly variant with air velocity. Thus, in the case of the present invention, attraction is strongest closest to a location where air movement in the plane is fastest, and diminishes with distance from such location as air speed decreases.

An embodiment of the present invention has an air inlet or air inlets placed orthogonal to and at or near the center of the radiating plane of moving air. In some cases, the inlet or inlets may be restricted or narrowed to increase air velocity at the inlet and thus further decrease air pressure and increase inlet drawing power.

When apparatus according to invention is placed in an area, its plane of moving air generally attracts air on both sides of the plane towards the plane, and in particular towards the center of the radiating plane where the apparatus is located and air movement is fastest. At or near the center of the plane is the air inlet of the apparatus which attracts air by creating a second low pressure area by rapid air movement and air evacuation.

Many types of air movement means may be used including, for example, centrifugal, axial and other types of fans, as well as electrostatic, heat convection and-or other air movement apparatus. Such air movement means as well as motors and other devices to drive them are well know to those knowledgeable in the art. Power may be derived from electrical wall outlets, wall pack transformers, batteries, solar cells and-or other power sources.

Many types of air filtration means may be used in the apparatus alone or in combination including, but not limited to: particulate filters, chemical and-or odor filters such as activated carbon, as well as ionizers and-or electrostatic filters. Such air purification means are also well known to those knowledgeable in the art.

The scale of equipment in accordance with the present invention may be of any practical size for a given application. Thus a unit might be a few inches on a side and plug directly in a car's cigarette lighter plug, or it might be console sized, about thirty inches in height and be placed on the floor, or it might be built into a room in a wall, floor or ceiling. A practical size for a home and-or office is about twice the size of an unabridged dictionary with a handle so it might be carried from one area to another. Such a device could be placed on a counter or table top, or on the floor, or be mounted to a wall or ceiling.

DETAILED DESCRIPTION

Figure 1:
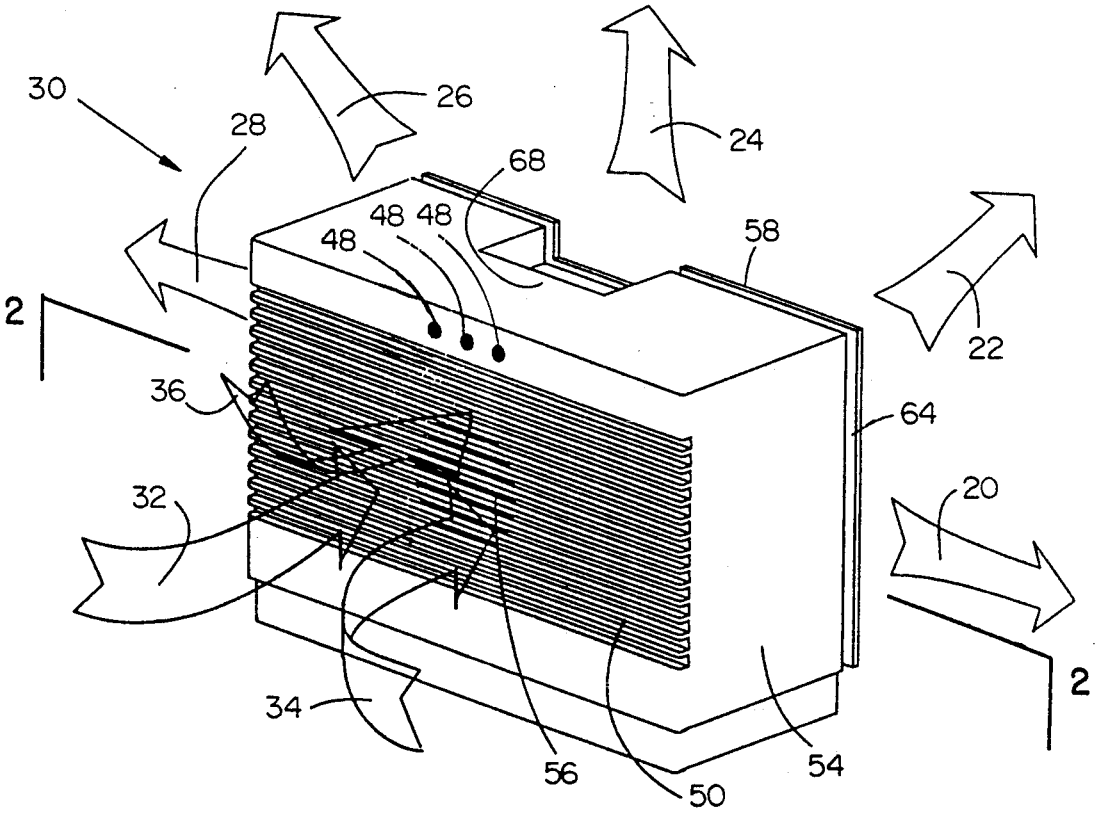
FIG. 1 is a perspective view of a device built in accordance with the present invention showing air movement around the device.

Referring to FIG. 1, arrows 20, 22, 24, 25, 28 fanning out from the back of a first embodiment filtering or air cleaning device 30 indicate a radiating vertical plane of moving air generated by device 30. Additional arrows 32, 34, 36 in front of the device show air being attracted to and drawn into the device's inlet.

Figure 2:
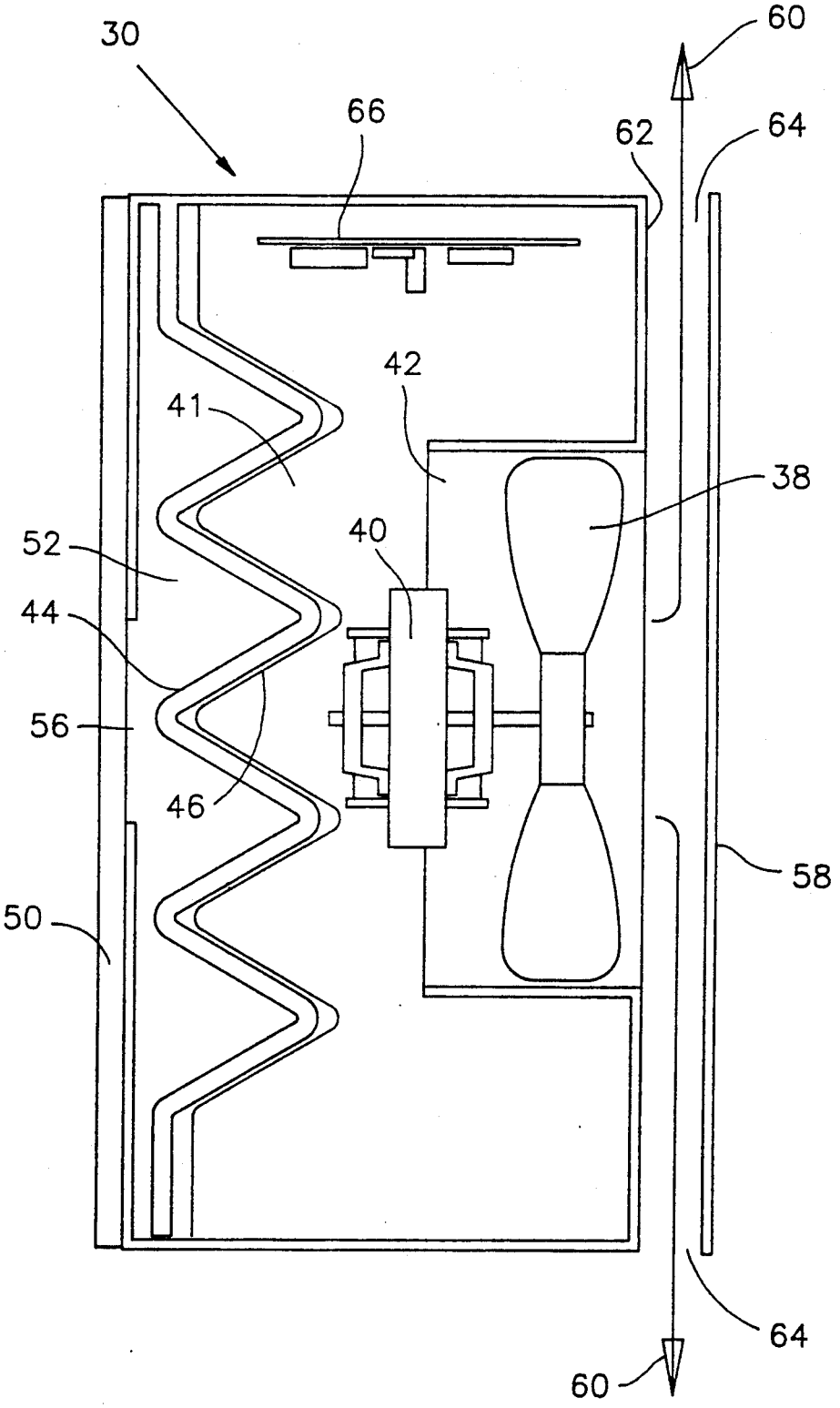
FIG. 2 is section on line 2—2 of FIG. 1 showing a top sectional view of internal components of the device.

Referring to FIG. 2, the first embodiment device has an internal ducted axial fan 38 driven by a shaded pole motor 40 which moves air through the device.

In operation, air is attracted to the vicinity of the device 30 and-or to the device 30 itself by the radiating vertical plane of moving air 20, 22, 24, 26, 28, 60 created by the device 30. Some of the attracted air along with pollutants it contains is then statically charged by ionizer needles 48 located in a front grill 50 of the device and powered by internal circuitry 66 (variations of construction of such circuitry being well known to those knowledgeable in the art). The device has a relatively small air inlet 56 which causes increased air velocity and commensurate decreased air pressure. The lower air pressure as well as air evacuation into the device 30 attracts and pulls air into and through the air inlet 56 and into an outer plenum area 52 behind the inlet. From the outer plenum area 52, the air is drawn through an activated charcoal filter pad 44 which is bent in corrugated fashion to increase its surface area. Such an activated charcoal pad may be about $\sqrt[3]{}$-inch thick and made from non-woven polyester dipped in a slurry containing activated charcoal. Such pads are in common use in air filtering devices. Other activated charcoal pad constructions may also be used. The activated charcoal filter pad 44 rests against an electrically grounded bare stainless steel screen 46 which causes the pad 44 to attract and retain particulated airborne impurities statically charged by the ionizer needles 48. Thus the activated charcoal pad 44 filters both particulate and gaseous pollutants with the minimal air passage restriction of a one state activated charcoal filter. Such an arrangement also helps reduce or eliminate soiling of furniture, walls and carpeting which might otherwise be caused by the ionizer needles 48. After passing through the activated charcoal pad 44, the air enters an inner plenum area 41 which feeds the intake of the shaded pole motor 40 powered ducted fan 38. Exhaust air from the fan strikes a flat air deflector 58 which forces formation of the radiating vertical plane of moving air 20, 22, 24, 25, 28, 60 by directing air through a slot 64 extending along the periphery of a back wall 62 of the device between the back wall 62 and the flat air deflector 58. It will be evident that deflector 58 may be suitably attached by spacers or the like (not shown) to the back wall.

A handle 68 located near the top and back of the device allows users to carry the unit from one area to another, such as to a kitchen for eliminating odors caused by food preparation, or to a living room table to block and filter cigarette smoke.

As an example, for general household use, the device may have a 6 inch diameter fan, operated by $\frac{3}{8}$–$\frac{1}{2}$ inch stack shaded pole motor operating at 120 volts. These figures are exemplary only.

Figure 3:
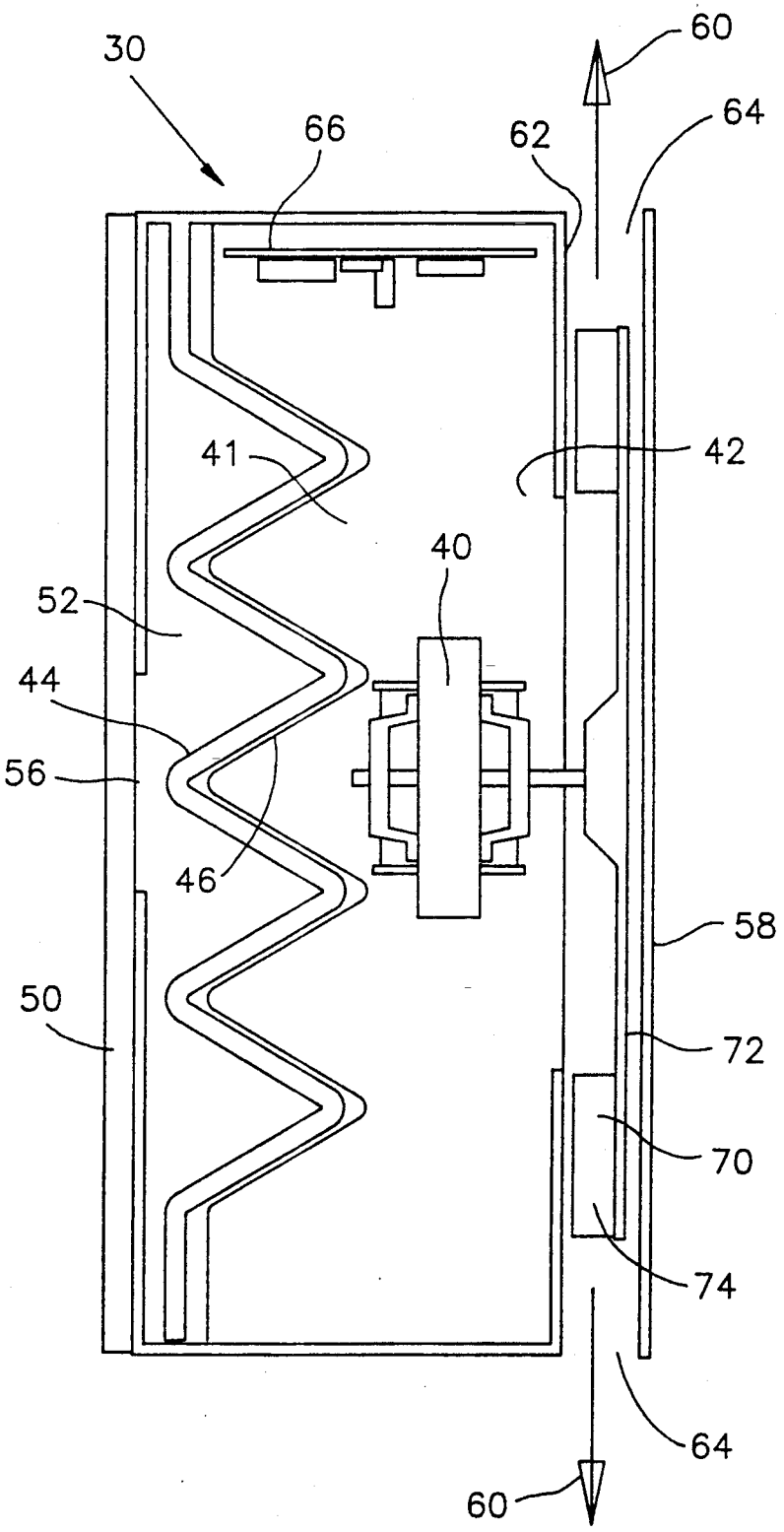
FIG. 3 is a view similar to FIG. 2, but showing the use of a centrifugal fan.

Referring to FIG. 3, a centrifugal fan 70 is shown which replaces the axial fan shown in FIG. 2. The centrifugal fan consists of a circular disc 72 with about 12 radial vanes 74 orthogonally extending from its surface.

It is evident that the device filters the air which passes through its interior and also produces a barrier plane of moving air 20, 22, 24, 26 which blocks passage of air from one side of the plane to the other.

Embodiments of the present invention may be made using many different materials alone or in combination, such as plastics, metals and-or other materials. Methods for such fabrication are well known to those knowledgeable in the art.

As can be seen from the above description and specification, the present invention improves over prior air filtration means by providing locatable means to block movement of impure air from one area to another. It also improves by providing means to remotely draw air borne impurities to its inlet rather than relying on random ambient air movement. Finally, it improves over common forms of air filters by providing a one stage activated charcoal filter which removes chemicals, odors and particulate.

Within this specification the term "vertical plane" is used to refer to planes and sections of planes of moving air and low pressure which are orthogonal to a given ground plane, regardless of direction of air flow at any particular point within the plane. Thus directly to the right or left of an embodiment of the present invention air may be moving within a "vertical plane" but may have a direction of flow (arrows 20, 28) parallel with the ground plane.

What has been described above are certain aspects of an air cleaning device It is understood that the foregoing description and accompanying illustrations are merely exemplary and are in no way intended to limit the scope of the invention, which is defined solely by the appended claims and their equivalents. Various changes and modifications to the preferred embodiments will be apparent to those skilled in the art. Such changes and modifications may include, but are not limited to: the device oscillating from side to side or up and down or having oscillating louvers on the inlet or outlet of the device which regularly alter the direction of suction, draw or deflection; the air inlet or air inlets being placed other than orthogonally to the plane of moving air such as cocked at an angle left or right and-or up or down; the air inlet and-or outlet having adjustable louvers which direct the plane of moving air and-or the direction of draw of the inlet; the vertical plane of air radiating more or less than the 180 degrees plus shown; using other air filtration means such as grounded precipitator plates or metal mesh filter to filter ionizer air; creating air movement using electrostatic air charge or heat convection or by using other types of fans such as squirrel cage blowers; using multiple vertical planes of moving air to attract and deflect ambient air instead of the single plane shown; bending or curving the vertical plane of moving air such that it is still substantially vertical but is curved or bent when viewed from above; not using all the air cleaning means shown such as eliminating the filter 44 or eliminating the ionizing needles 48; adding other features such as felt wicks to humidify and cool air passing through the unit and-or adding scenting devices; etc.

Such changes and modifications can be made without departing from the spirit and scope of the invention. Accordingly, it is intended that all such changes and modifications be covered by the appended claims and equivalents.

I claim:

1. A room air cleaning device comprising:

a box housing having an air inlet and an air outlet provided therein;

a vertical baffle coupled to said box housing opposite said air outlet and spaced from said box housing such that an air egress outlet is formed between said vertical baffle and said box housing;

air cleansing means substantially disposed within said box housing and cleansing air passing into said inlet and out of said air egress outlet;

a fan disposed within said box housing, said fan providing air movement through said air inlet and said air egress outlet;

wherein air exits the room air cleaning device through said air egress outlet as a vertical plane of moving air; and wherein formation of said vertical plane of moving air contributes to the formation of a low pressure area drawing impure air toward said air inlet.

2. The device of claim 1 wherein said box housing is a hand carried portable enclosure.

3. The device of claim 1 wherein said air egress outlet is configured so that said plane of moving air radiates over at least 180 degrees of arc.

* * * * *